United States Patent [19]

Wright

[11] Patent Number: 4,535,490

[45] Date of Patent: Aug. 20, 1985

[54] INFLATABLE HOT TUB WITH COVER

[75] Inventor: Robert B. Wright, Akron, Ohio

[73] Assignee: The B. F. Goodrich Company, New York, N.Y.

[21] Appl. No.: 542,847

[22] Filed: Oct. 17, 1983

[51] Int. Cl.[3] ..... A47K 3/06

[52] U.S. Cl. ..... 4/585; 4/584; 4/488; 4/542

[58] Field of Search ..... 4/588, 541, 506, 542, 4/503, 502, 499, 488, 585, 498; 128/66

[56] References Cited

U.S. PATENT DOCUMENTS

| | | | |
|---|---|---|---|
| 755,747 | 3/1904 | Coile | 4/588 |
| 2,718,014 | 9/1955 | Mizrach et al. | 4/506 |
| 3,058,122 | 10/1962 | McDaniel et al. | 4/588 X |
| 3,354,472 | 11/1967 | Steinbeck | 4/503 |
| 3,391,410 | 7/1968 | Melberg | 4/503 |
| 3,916,457 | 11/1975 | Morita | 4/502 |
| 4,048,678 | 9/1977 | Chillino | 4/499 |
| 4,068,326 | 1/1978 | Deschler | 4/588 |
| 4,136,725 | 1/1979 | Phillips et al. | 4/585 |

*Primary Examiner*—Henry K. Artis

*Attorney, Agent, or Firm*—Michael J. Colitz, Jr.; Woodrow W. Ban

[57] ABSTRACT

An inflatable hot tub is provided with one or more stacked endless loops of inflatable tubes and sidewalls and a floor or bottom wall. An insulating cover, preferably secured around its entire periphery with an elastic band to the topmost tube, is manually removable and provides insulation by preferably either rigid closed cell synthetic foam or one or more inflation chambers. The tubes may be connected together and to the bottom wall. Pressurized gas may be provided in air jet bubbles to the bottom of the tub through a motor driven pump and heater, with a supply hose extending over the top periphery of the tubes or through the bottommost tube and side wall if present. The air jets may lead from a rigid or flexible pipe or combinations thereof, extending around the lower periphery of the floor, which pipe may be circular in cross section or of quarter-round cross section having its right angle portion fitting in the corresponding right angled joint between the side and bottom walls of the tub. A floor drain may be provided with a conventional rotatable hose coupling.

15 Claims, 7 Drawing Figures

INFLATABLE HOT TUB WITH COVER

BACKGROUND OF THE INVENTION

The present invention relates to the field of hot tubs, which are pleasure bathing or soaking tubs that employ heated water, preferably with injected air and of a size and shape to hold a few people, and at least one person. Usually, such tubs are made out of wood or fiberglass, and they are quite expensive.

SUMMARY OF THE INVENTION

It is the object of the present invention to provide a relatively inexpensive tub that is also efficient and satisfactory for the purpose intended.

The present invention relates to a hot tub formed with inflatable tube sides, which reduces the cost of the same and also provides for user comfort and for reasonable side insulation against heat loss from the heated water. Further heat loss is provided by insulating a cover that wraps around the top tube for efficient and simple installation. There are various construction details that facilitate manufacturing and reduce cost, such as the employment of V-shape tapes in assembly, side walls integral with the bottom sheet constituting the floor, air inlet tubes extending through the side tubes, a drain tube with a conventional rotatable hose coupling, and a bottom peripheral air inlet pipe stabilizes the junction between the bottom and side wall.

Further objects, features and advantages of the present invention will become more clear from the following detailed description of a preferred embodiment of the present invention, with modification.

BRIEF DESCRIPTION OF THE DRAWING

A preferred embodiment, with variations, is shown in the accompanying drawing, wherein.

DETAILED DESCRIPTION

Figure 1:
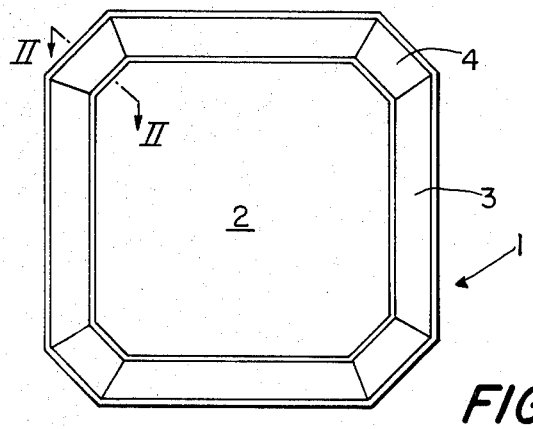
FIG. 1 is a top plan view of a hot tub, according to the present invention.
Figure 7:
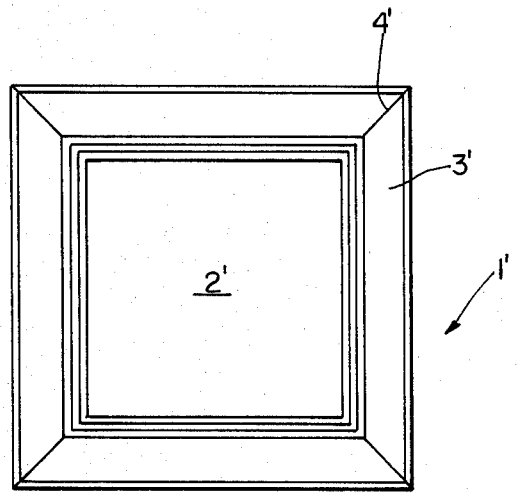
FIG. 7 is a view corresponding to FIG. 1 and showing a modification of the overall shape of the hot tub.

The hot tub of the present invention may be embodied in different shapes, for example the square shape of FIG. 7 or the square shape with truncated corners of FIG. 1. Round, triangular and other polygonal shapes are contemplated. While two tubes have been shown, it is understood that the hot tub may be constructed with one, three or more tubes, and still embody some of the broader aspects of the present invention.

Figure 2:
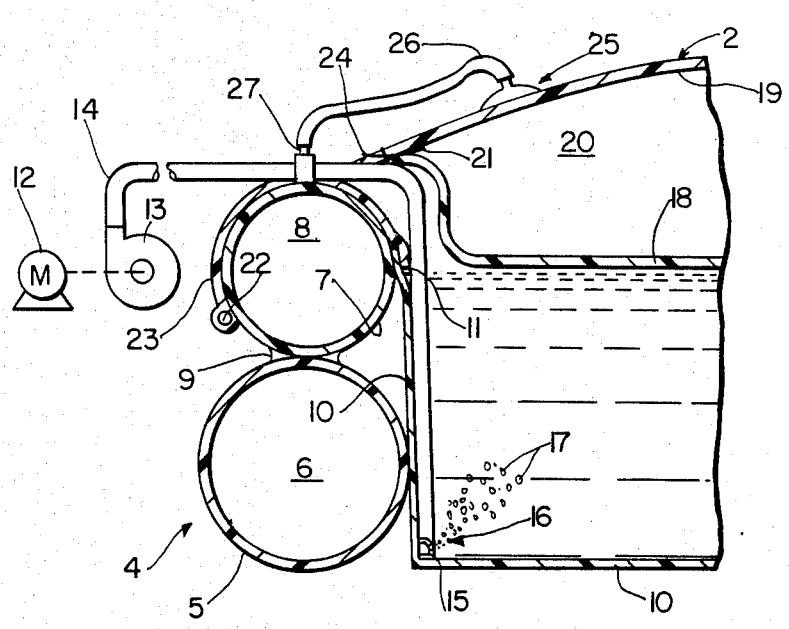
FIG. 2 is an enlarged cross sectional view taken along line II—II of FIG. 1, showing greater detail.

The hot tub 1, as shown in FIG. 1 and FIG. 2, has a peripheral portion 3 overlapping and manually releasably secured to a vertical wall structure 4. The vertical wall structure 4 includes at least inflatable tubes 5, 7, each of which is composed of flexible air impermeable sheet material forming one or more inflation chambers 6, 8, respectively. Each tube 5, 7 extends in a closed horizontal loop, for example, rectangular as shown in FIG. 7. The tubes 5 and 7 may be joined together, if desired, by bonding 9. The walls of the tube 5, 7 may be constructed of rubber coated fabric or other suitable materials, natural or synthetic or blends thereof, coated or not coated. If joined together, the tubes 5 and 7 may be adhered, cohered, cemented or otherwise joined.

A liquid impervious sheet material bottom 10 extends horizontally and generally coextensive with the interior area of the loop formed by the tubes 5, 7. A sheet material side wall is of the same sheet material 10 as the bottom. If desired, the side wall may be made from other sheet material than the bottom. The side wall extends around the entire periphery of the hot tub and is imperviously joined at its lower entire periphery to the bottom. The top periphery of the side sall is liquid imperviously joined to the top of the tube 7 by means of a joining strip 11, which is preferably fused or adhesively secured respectively to the side wall sheet material 10 and the tube 7. Alternatively, the side wall sheet material 10 may be directly bonded or adhered to the tube 7. With the material 10 being impervious to liquid, an upwardly opening tub is formed that is supported on the sides the tubes 5, 7. Further, it is possible to have the bottom sheet material 10 end where it is connected to the lowermost tube 5. Preferably, the lowermost tube 5 is of a larger cross section than the uppermost tube 7. The cross sectional shape being circular as shown, or other shapes.

Figure 3:
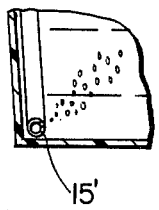
FIG. 3 is a cross sectional view corresponding to a portion of FIG. 2, showing a modification.
Figure 4:
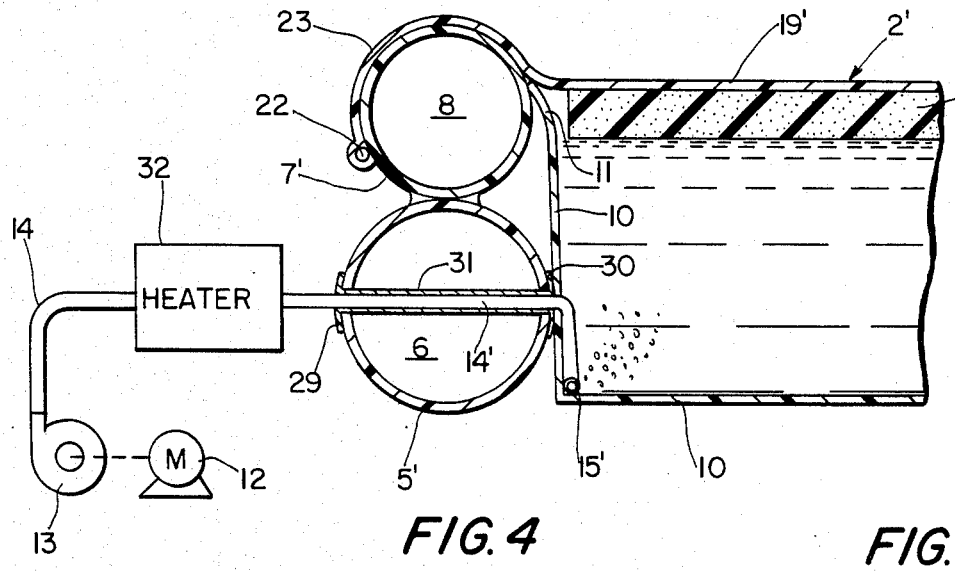
FIG. 4 is a cross sectional view corresponding to FIG. 2 and showing further modification.
Figure 5:
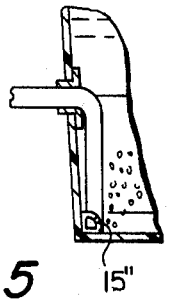
FIG. 5 is a partial cross sectional view similar to FIG. 3, but showing an additional modification.
Figure 6:
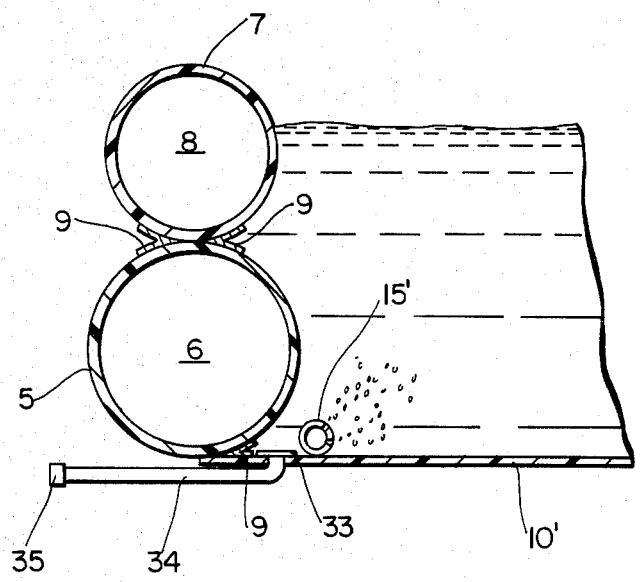
FIG. 6 is a cross sectional view corresponding to FIG. 2, and showing a further modification.

Pressurized air, i.e. air at higher than atmosphere pressure, or positive power pressure, is provided to the lower interior periphery of the hot tub for agitation and other known reasons. The electric motor 12 is operatively connected to a blower or air pump 13, which delivers high pressure air to a pipe or conduit 14. The conduit 14 extends over the top of the side wall structure 4 as shown in FIG. 2 and then down along the inner periphery of the hot tub, preferably the inner periphery of the side wall sheet material 10, into where it delivers pressurized air to a pipe 15 which can be rigid or flexible or a combination of rigid and flexible members. Preferably, the pipe 15 extends around the entire periphery of the hot tub and the joint between the side wall and the bottom. A plurality of nozzles 16 eject the high pressure air from the rigid pipe 15 in a plurality of jets of air bubbles based along the length of rigid pipe 15 for ejecting corresponding streams of gas bubbles into the hot tub. The pipe 15 may be of a quarter-round cross section shape as shown in FIG. 2 at 15 or FIG. 5 at 15''. Alternatively, a round shape may be employed for the pipe 15' as shown in FIG. 3, 4 and 6. When a quarter round shape is used, the arcuate portion faces inwardly and upwardly, whereas the horizontal and vertical portions respectively extend along the bottom and side walls.

The cover of each embodiment is an insulated cover. Two embodiments of insulation are shown. In FIG. 2, the insulation takes the form of a second sheet of air impermeable material that is substantially coextensive with the open top of the tub and secured around its entire periphery hermetically to a first sheet of material 19 forming the cover, to form there between an inflatable chamber FIG. 20. The two sheets of material 18, 19, may be secured together by means of fusion, an adhesive material or an adhesive backed V-shaped tape, all as broadly at 21. Either or both of the sheets 18, 19 extends across the top of the topmost tube 7, and then is provided with a device for manually releasably securing the cover to the entire periphery of the top tube 7. More specifically, the other periphery 23 of the cover extends completely over the top of the tube 7, vertically along the outside of the tube and then inwardly and downwardly from the outermost periphery of the tube to a terminal periphery, with the terminal periphery secured by a structure for contracting the outermost periphery of the cover at 22. Most preferably, this contracting is provided by an elastic cord attached to the outer periphery of the cover at 22. Alternatively, a drawstring (not shown) could be employed. At a suitable location, a through aperature 24 is provided in the cover 2, through one or more of the sheets 18, 19, for passing there through th conduit 14. For inflating the chamber 20, there is a one-way valve 25 secured to the sheet 19 and an air supply pipe 26. High pressure air supplied from the pipe 26, through coupling 27 joining to the conduit 14, passes through the one-way valve 25 into chamber 20. Discontinuance of air pressure will close the one-way valve 25 to prevent the escape of pressurized air from the chamber 20 in the cover. The valve 25 may be of any construction, and include a manner in which the valve may be actuated to release air from the chamber 20 and deflate the cover, for example when it is desired to fold up the cover and store the same in the summer. Also, the coupling 27 may be in the nature of a three-way valve, to selectively provide pressurized air to either the inflation chamber 20 on the cover or the nozzle means 16.

The manner in which the cover may be insulated, according to the broader aspects of the present invention, may take on other forms. As shown in FIG. 4, the cover 2", having a sheet material 19", is provided with a slab 28 of insulation material. Preferably the slab 28 is shaped to be coextensive with the open top of the tub and of a thickness to provide adequate insulation. Preferably, the slab 28 is a thick sheet of rigid synthetic resin foam adhesively secured to the underside of the sheet 19". The foam is preferably of a closed cell construction and may be made of well known materials, for example, polyurethane.

The conduit 14 of FIG. 2 may extend into the interior of the tub in various other manners. For example, in FIG. 4, a conduit 14" extends through a passageway in the tube 5" and through the sheet material 10 of the side wall. The passageway in the tube 5" is formed by an annular flange bonded, adhesively secured or otherwise attached in an air impervious manner to the tube 5" around a hole in the tube 5". At the opposite end, a similar flange 30 is secured to the tube 5". Between the flanges 29 and 30, there extends a tube 31. Together, the flanges 29, 30 and tube 31 form an air impervious passageway through the tube 5" for receiving the conduit 14". If desired, heat may be provided for the air being supplied to the nozzles. For this purpose, a heater 32 has been shown connected within the conduit 14, and it may be of any conventional construction.

In an embodiment of FIG. 6, the bonding 9 is more clearly shown as being an adhesive backed V-shaped tape, that is, the adjacent tubes 7, 5 are secured around their entire common periphery by an annualar V-shaped strip of tape adhesively secured to the outermost periphery of the bottom tube and the lower periphery of the upper tube.

In any of the embodiments, a drain fitting 33 extending vertically through the bottom wall sheet material 10" may be connected to the drain pipe 34, which has in its opposite end a conventional rotatable hose coupling, such as that employed on a common garden hose. With such a coupling 35, a garden hose may be attached to drain the hot tub to any desired location, or alternatively a threaded plug may be inserted in the coupling 35 to prevent draining of the hot tub. Most preferably, the garden hose is attached to the coupling 35 and the opposite end of the garden hose is provided with the removable plug to prevent draining until desired.

As shown in FIG. 6, many features of the present invention may be employed without a side wall for the sheet material 10". Namely, the sheet material 10" forming the bottom in FIG. 6 is directly connected to the lowermost portion of the lower tube 5 by a water impervious seal 9, such as the above mentioned V-shaped tape.

Various modifications have been shown in the different figures, in specific combinations. It is contemplated that these modifications may be combined in a different manner than shown. For example, the drain 33, 34, 35 FIG. 6 may be provided in the structure of any one of FIGS. 2–5, the covers of FIG. 2 and 4 may be interchangeable, and the bottom construction of FIG. 6 may be employed in FIGS. 2 or 4. Other combinations are readily seen.

While the preferred embodiment of the present invention has been set forth in detail sufficient to disclose the invention and to illustrate important details, modifications and variations have been shown according to some of the broader principles while other broad principles have the preferred embodiment. Further modifications, variations and embodiments are contemplated within the spirit and the scope of the following claims:

What is claimed is:

1. An inflatable hot tub, comprising:

an endless inflatable tube composed of flexible sheet material and having inflation coupling means for introducing pressurized gas to its interior for inflating the same, said tube extending in a closed horizontal loop;

a liquid impervious sheet material bottom extending horizontally and generally coextensive with the interior area of said tube loop;

means joining said bottom around its entire periphery to said tube in a liquid impervious manner to form therewith an open top tub for containing liquid;

a sheet material cover generally coextensive with the open top area of said tub, and including means for securing said cover in a manually releasable manner around the entire top periphery of said tube and heat insulating means secured to said sheet cover within the open top area of said tub;

a rigid pipe extending around generally the entire periphery of the inside of said hot tub adjacent said bottom, and having a plurality of nozzle means spaced along its length for ejecting a stream of gas bubbles into said hot tub when pressurized; and means supplying pressurized air to said tube.

2. The hot tub according to claim 1, wherein said means for securing said cover include the outer periphery of said cover extending completely over the top of said tube, horizontally along the outside of said tube and then inwardly and downwardly from the outermost periphery of said tube, and further including means for contracting the outermost periphery of said cover.

3. The hot tub according to claim 2, wherein said means for contracting is an elastic band extending around the entire outermost periphery of said cover.

4. The hot tub according to claim 1, wherein said insulating means includes a sheet of rigid synthetic resin foam generally coextensive with the open top of said tub and secured to said cover.

5. The hot tub according to claim 4, wherein said foam is of closed cell construction.

6. An inflatable hot tub, comprising:

an endless inflatable tube composed of flexible sheet material and having inflation coupling means for introducing pressurized gas to its interior for inflating the same, said tube extending in a closed horizontal loop;

a liquid impervious sheet material bottom extending horizontally and generally coextensive with the interior area of said tube loop;

means joining said bottom around its entire periphery to said tube in a liquid impervious manner to form therewith an open top tub for containing liquid;

a sheet material cover generally coextensive with the open top area of said tub, and including means for securing said cover in a manually releasable manner around the entire top periphery of said tube and heat insulating means secured to said sheet cover within the open top area of said tub, said insulating means being a second sheet of material substantially coextensive with the open top of said tub and secured around its entire periphery hermetically to said cover to form there between an inflatable chamber; and a means for providing high pressure air in a plurality of jet streams of bubbles adjacent the bottom of said tub; and valve means selectively connectable to said pressurized air providing means for inflating said cover.

7. An inflatable hot tub, comprising:

an endless inflatable tube composed of flexible sheet material and having inflation coupling means for introducing pressurized gas to its interior for inflating the same, said tube extending in a closed horizontal loop;

a liquid impervious sheet material bottom extending horizontally and generally coextensive with the interior area of said tube loop;

means joining said bottom around its entire periphery to said tube in a liquid impervious manner to form therewith an open top tub for containing liquid;

a sheet material cover generally coextensive with the open top area of said tub, and including means for securing said cover in a manually releasable manner around the entire top periphery of said tube and heat insulating means secured to said sheet cover within the open top area of said tub; and a means extending through said tube horizontally for supplying pressurized air to the interior of said tub; and a nozzle means for receiving air from said pipe means and providing a plurality of air bubble jets adjacent the bottom of said tub.

8. The hot tub according to claim 7, further including a sheet material side wall extending around substantially the entire periphery of said hot tub and being imperviously joined at its lower entire periphery to said bottom wall and partially forming said means joining said bottom wall to said tube; said pipe means extending through said side wall.

9. The hot tub according to claim 8, including a second endless inflatable tube extending in a closed loop below and substantially coextensive with said first mentioned tube; and means securing said second tube to said first tube and said side wall.

10. The hot tub according to claim 9, wherein said second tube is of larger cross sectional area than said first mentioned tube.

11. The hot tub according to claim 1, wherein said supplying means includes an electric motor, an air pump operatively and drivingly coupled to said electric motor for producing pressurized air, and conduit means for supplying the pressurized air from said pump to said pipe.

12. The hot tub according to claim 11, wherein said conduit means extends across the upper periphery of said tub, downwardly along the inner periphery of said tub and to said pipe.

13. The hot tub according to claim 11, wherein said conduit means extends through the cross sectional inflatable interior of said tube from the outside to the inside of the tube loop.

14. The hot tub according to claim 1, wherein said rigid pipe has a cross sectional one-quarter round shape with its arcuate wall facing upwardly and inwardly with respect to the tub and its horizontal wall contacting said bottom.

15. The hot tub according to claim 1, further including means for heating the air supplied to said pipe.

* * * * *